United States Patent [19]

Feil

[11] 4,394,553

[45] Jul. 19, 1983

[54] SNAP ACTION SWITCH

[75] Inventor: Paul G. Feil, Evansville, Ind.

[73] Assignee: AMF Incorporated, White Plains, N.Y.

[21] Appl. No.: 256,280

[22] Filed: Apr. 23, 1981

[51] Int. Cl.[3] ..... H01H 5/22

[52] U.S. Cl. ..... 200/67 DA; 200/153 T; 200/332; 200/67 D

[58] Field of Search ..... 200/67 D, 67 DA, 153 T, 200/332, 335

[56] References Cited

U.S. PATENT DOCUMENTS

| | | | |
|---|---|---|---|
| 2,547,765 | 4/1951 | Lund | 200/335 |
| 2,828,372 | 3/1958 | Bulgin | 200/17 R |
| 3,141,075 | 7/1964 | Brevick et al. | 200/332 |
| 3,144,529 | 8/1964 | Zemke et al. | 200/67 D |
| 3,336,449 | 8/1967 | Ashman | 200/67 D |
| 3,382,339 | 5/1968 | Anderson | 200/160 |
| 3,392,254 | 7/1968 | Long | 200/307 |
| 3,476,898 | 11/1969 | Ehrenfels et al. | 200/67 D |
| 3,588,423 | 6/1971 | Hallerberg | 200/302 |
| 3,681,554 | 8/1972 | Arthur | 200/332 |
| 3,767,881 | 10/1973 | Sharples | 200/153 T |
| 3,832,508 | 8/1974 | Beck | 200/332 |
| 3,878,347 | 4/1975 | Roeser | 200/67 D |
| 3,989,914 | 11/1976 | Stearley et al. | 200/67 D |
| 4,063,056 | 12/1977 | Baker | 200/332 |

*Primary Examiner*—John W. Shepperd

*Attorney, Agent, or Firm*—David E. Dougherty; Charles J. Worth

[57] ABSTRACT

A micro-switch having an actuating mechanism comprising a pusher bearing directly on a conductive contact carrying spring blade which is trap mounted and pivotable at an anchor point distal from said contact(s), and a lever actuator hinge mounted to the switch case by means of laterally projecting trunnions having flat portions which are pivotable on fulcrum pivot points formed integrally in spaced axially aligned alcove portions in the switch case.

7 Claims, 8 Drawing Figures

SNAP ACTION SWITCH

BACKGROUND OF THE INVENTION

This invention relates generally to switches and more particularly to snap action switches having a single active member snap action mechanism in combination with a lever actuator.

DESCRIPTION OF THE PRIOR ART

Snap switches are provided with many different types of actuating levers which are mounted in various ways such as by means of a wire-form hinge member of U-shape having a bight portion connected to the switch case as described in U.S. Pat. No. 3,484,572 issued Dec. 16, 1969 to Lawrence W. Froyd.

Also typical of the prior art is the use of a cantilevered moveable contact-carrying spring blade unit having a (fixed) end portion riveted to a support structure as illustrated in U.S. Pat. No. 3,270,156 issued Aug. 30, 1966 to R. E. Stewart.

Other prior art patents of interest includes U.S. Pat. Nos. 4,230,919 issued Oct. 28, 1980 to Spencer C. Schantz et al.; 4,118,116, issued Oct. 3, 1978 to Robert F. Purssell et al.; 3,270,156 issued Aug. 30, 1966 to R. E. Stewart.

In contrast to the prior art devices, the present invention provides a subminiature switch having a simple, robust and relatively inexpensive two part mounting system having a single active member snap action mechanism in combination with a trapped rather than fixed mounting structure, a moveable contact-carrying spring blade having a pivotable rigid tongue member and which is held in position by spring tension, a generally flat lever actuator having laterally projecting trunnions with flat portions which are pivotable on fulcrum pivot points formed integrally in recesses of the switch case, and involves a minimum of associated parts.

SUMMARY OF THE INVENTION

Generally speaking, the present invention relates to a subminiature snap action switch comprising a plastic case having spaced walls containing laterally aligned recesses or formed cavities with a fulcrum type pivot point integrally formed therein, a trap mounted snap spring blade mechanism having a movable contact carrying end and a second end which is held under spring tension and pivotable on or about a fixed mounted anchor point, a plunger associated with said blade member and actuatable to dispose the free (contact carrying) end of said blade into and out of engagement with a fixed contact(s), and a lever actuator having axially aligned trunnion portions extending laterally therefrom each rotatably into a different one of said recesses and having a flat portion pivotally associated with a fulcrum pivot point within the respective recess.

Accordingly, an object of the present invention is to provide an actuating lever hinging means for a snap switch or the like which is of relatively uncomplicated rugged construction and can be manufactured with facility.

Another object of the invention is to provide the foregoing hinge means which facilitates assembly of the switch.

Another object of the present invention is to provide a hinge means to enable the use of a flat lever actuator and trunnion portions thereof to be rotatably and pivotally mounted in association with fulcrum pivot points integrally formed in recesses in a plastic case.

And another object of the invention is to provide a two part system having a single active member snap action mechanism which utilizes a pivotable rigid tongue and tensioned arm members in a trapped, rather than fixed, mounting system for improving the mechanical/fatigue characteristics of the spring blade.

Still another object of the present invention is to provide a flat conductive snap spring blade having a movable contact carrying end and a second end which is pivotally mounted under spring tension to an anchor point.

The foregoing and other objects and advantages of the invention will appear more fully hereinafter from a consideration of the detailed description which follows, taken together with the accompanying drawings wherein a preferred embodiment of the invention is illustrated by way of example. It is to be expressly understood, however, that the drawings are for illustration purposes only and are not to be construed as defining the limits of the invention.

Figure 1A:
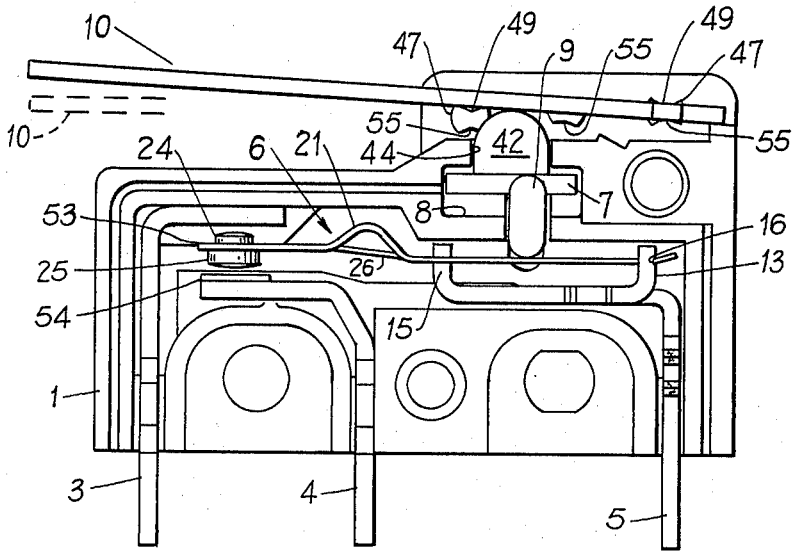
FIG. 1A is a longitudinal sectional view, with the other half of the case shown in FIG. 1B removed, of a snap switch constructed in accordance with one embodiment of the invention.
Figure 1B:
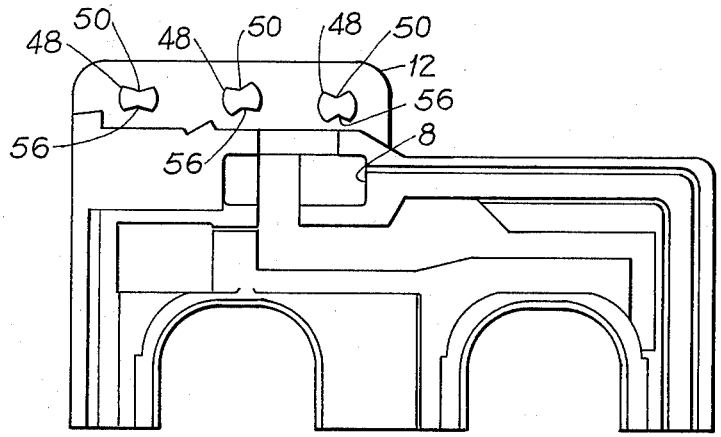
FIG. 1B is a longitudinal side view of the mating half of the case half shown in FIG. 1A.

With reference to FIGS. 1A and 1B, the invention is applied to a plunger-operated snap switch comprising a two-part (split) plastic case 1 and 2, which may be joined together by conventional means such as ultrasonic welding. A first fixed terminal-contact 3 is secured to case portion 1. A second fixed terminal-contact 4 is secured to case portion 1 in such fashion as to be spaced from terminal-contact 3 by a predetermined distance at the distal end of the case 1, 2 opposite a common terminal 5. A moveable contact-carrying spring unit 6 is trap mounted to the terminal-bracket 5 by means of spring tension. An electrically insulative plunger or pusher 7 is (downwardly-upwardly) slidably positioned within a guide slot 8 of the case 1, 2 and has a lower projecting portion 9 for bearing on the moveable contact-carrying spring 6. An actuating lever 10 is hinge mounted to the case 1, 2 interposed between wall portions 11 and 12 of the assembled switch.

The terminal-support 5 (FIGS. 1A, 3A, 3B and 3C) is stamped, for example, from a ½ hard cartridge brass sheet to have, for ease of understanding, what might be described as a three (flat) legged chair, with two back legs 13 and 14, and a distal front center leg 15. A transverse groove or slot 16 and 17 is provided in the outwardly directing surfaces of legs 13 and 14, respectively. A transverse groove 18 is provided in the surface of the center leg 15. Staking or biting point means 19 may be provided to engage the case to facilitate stability of the terminal-support 5.

Figure 2A:
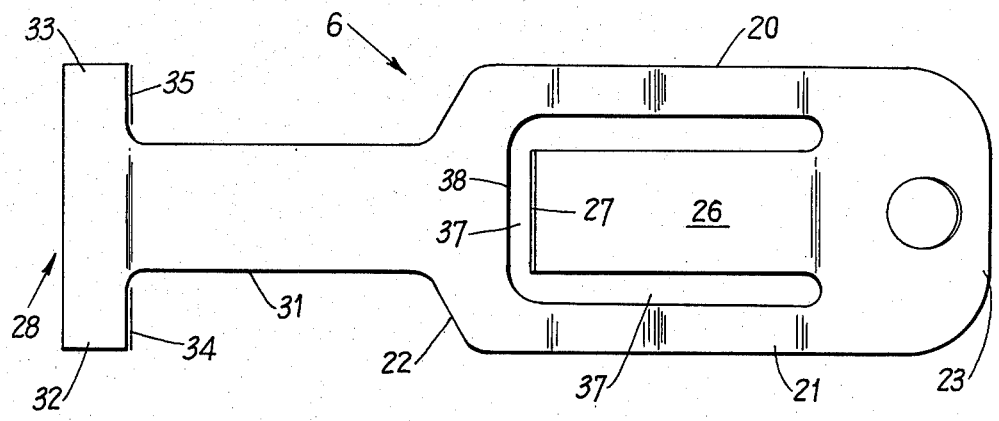
FIG. 2A is a bottom view of the movable contact spring of the device of FIG. 1.

The spring or switch blade 6 (FIGS. 1A, 2A and 2B) includes two elongated parallel side arms 20 and 21 interconnected at their respective ends by transverse portions 22 and 23. Portion 23 has rigidly secured thereto in any conventional fashion a pair of opposed contact buttons 24 and 25, each having a generally spherical contact surface. A tongue 26 integral with transverse portion 23, extends from that portion toward portion 22 and is disposed between arms 20 and 21. Tongue 26 is rectangular in plan and terminates in a straight bearing edge 27. Portion 22 tapers into an elongated trunk or shank portion 31. The distal end portion 28 is bent out of the normal plane of the shank portion 31 (FIG. 2B) and includes two laterally projecting trunnions 32 and 33 each having a bearing edge 34 and 35, respectively.

Figure 2B:
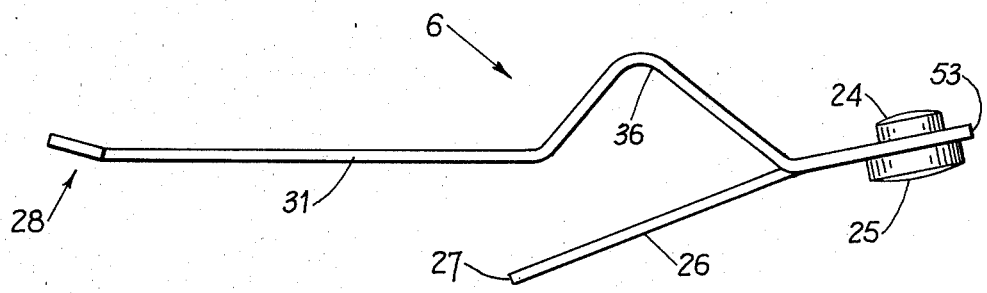
FIG. 2B is a side view of the movable contact spring shown in FIG. 2A.

Considering the spring or switch blade 6 to be in its completely relaxed, undistorted condition, as seen in FIG. 2B, arms 20 and 21 are each bent out of the normal plane of the blade as defined by the plane of the shank portion 31, in transversely aligned areas to provide identical curved portions 36 which are concave as viewed from the side of the blade occupied by contact 25 and convex as viewed from the side of the blade occupied by contact 24. Still considering spring or switch blade 6 in its completely relaxed condition, contact portion 23 is bent upward in the direction of contact 24 out of the plane of shank portion 31, but the tongue 26 is curved progressively out of that plane in the same direction in which contact 25 faces.

With reference to FIGS. 1A–3B, the embodiment of the single active member snap action mechanism in combination with a trapped rather than fixed mounting system will now be described.

As noted above, the terminal-support member 5 is secured to the switch casing 1, 2 with the switch common terminal end thereof being without the case.

Shank portion 31 of the spring or switch blade 6 is fitted between mounting legs 13 and 14, spaced above portion 36, of the terminal-support member 5. The front center leg 15 of the terminal-support member 5 is dimensioned to fit within the rectangular opening 37 of spring or switch blade 6 interposed between arms 20 and 21 and edges 27 and 38.

As noted above, end portion 28 is upwardly bent to project or extend an edge of each flat ended/sided trunnion 32 and 33 to thereby establish pivotable bearing edges 34 and 35. The bearing edges 34 and 35 are disposed in respective grooves 16 and 17 of the support-terminal 5. Grooves 16 and 17 have oblique angle portions 39 and 40 which form corners against which the bearing edges 34 and 35, respectively, are pivotably biased against, under the spring tension of arms 20, 21 with the rigid tongue pivotable at groove portion 18 of center leg 15. Thus, during manufacture the bearing edge 27 of tongue 26 is disposed into groove 18 of the center leg 15 urging spring or switch blade 6 longitudinally in the direction of terminal 3 against the spring tension of the formed arm members thereby pivotally constraining bearing edges 34 and 35 within grooves 16 and 17 of the terminal support legs 13 and 14, respectively. The concave portions of the arms 20 and 21 extend above the plane of the spring blade 6 (FIG. 1A) in the direction of lever 10 to provide tensile spring bias of the snap action mechanism. The width of the center leg 15 is approximately equal to that of tongue 26 so that the generally rectangular space formed between arms 20, 21 and transverse portions 22, 23 will permit the upward-downward movement of the spring or switch blade 6 with the center leg 15 disposed within the rectangular space 37.

In this manner, the spring or switch blade 6 is trap mounted under the spring tension of arms 20 and 21 with the tongue being pivotable against groove 18 of center leg 15 to thereby spring bias the bearing edges 34 and 35 of end portion 28 into the respective grooves 16 and 17 of leg members 13 and 14 of the terminal-support member 5.

The plunger or pusher 7 (FIG. 1A) includes a generally square base portion 41, an upwardly extending portion 42 and a downwardly projecting portion 9. The base portion is (upwardly-downwardly) slideably received in a guide space 8 of the casing 1, 2. Portion 42 is projected through an opening 44 of the case and interposed between walls 11 and 12 of the switch case 1, 2. Portion 9 extends downwardly for bearing on the shank portion 31 of the spring or switch blade 6.

Figure 4:
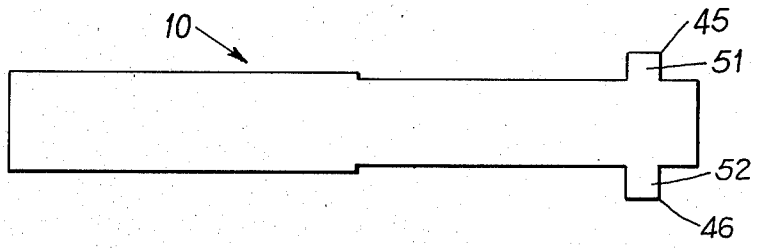
FIG. 4 is a top view of the actuating lever in accordance with the present invention.
Figure 3A:
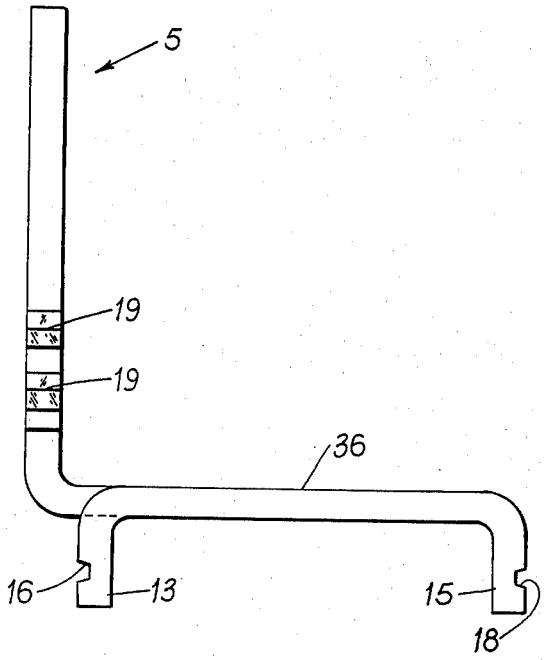
FIG. 3A is a side view of the terminal anchor unit in accordance with the present invention.
Figure 3B:
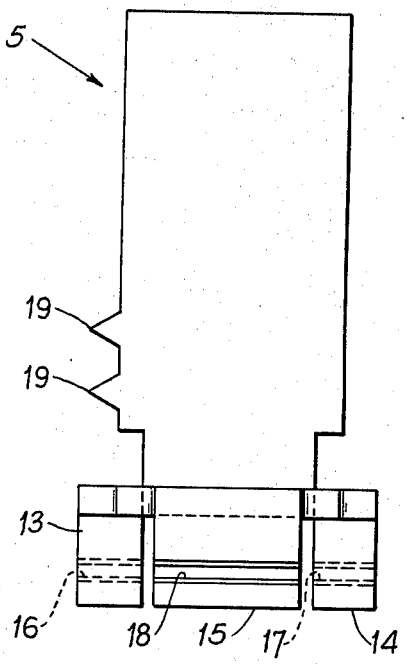
FIG. 3B is an end view of the terminal anchor illustrated in FIG. 3A.
Figure 3C:
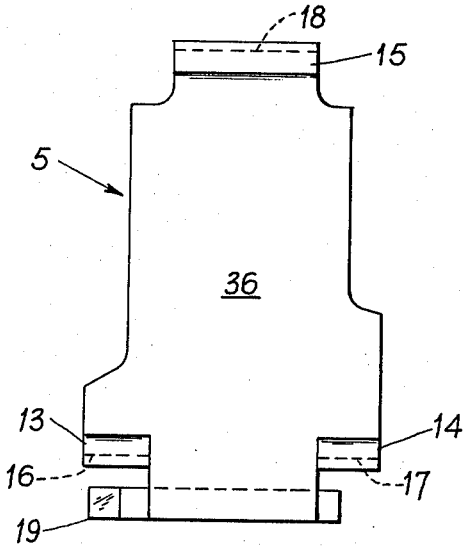
FIG. 3C is a top view of the terminal-support bracket shown in FIGS. 3A and 3B.

With reference to FIGS. 1A and 4, the lever actuator 10 comprises an elongate flat metallic lever having two laterally projecting trunnions 45 and 46. Each trunnion 45 and 46 includes an upper and lower flat portions.

As noted above, each half of the casing 1, 2 includes walls 11 and 12, respectively. Each wall portion 11 and 12 has integrally formed therein one or more recesses 47 and 48. The recesses or alcoves 47 and 48 each have downwardly projecting edge portions which function as fulcrum pivot points 49 and 50. The edge portions are formed generally as a thin edge or apex of inclined or tapered surfaces forming a wedge like structure within each formed recess 47 and 48 of casing halves 1, 2, respectively.

During switch assembly, case half 2 (FIG. 1B) is aligned with and affixed to case half 1 (FIG. 1A) to thereby secure the internal switch parts within the interior spaces of the switch. Each laterally projecting trunnion 45 and 46 is trapped within a respective axially aligned recess 47 and 48 thereby rotatably hinge mounting the lever actuator 10 to and disposed between parallel spaced apart walls 11 and 12.

The dimensions of the switch parts, in particular pusher 7, are designed so that lever 10 is held in an upward position (FIG. 1A) under the spring tension of switch or spring blade 6.

When the lever actuator 10 is forced or urged in a downward direction (as shown in phantom outline), the upper flat surfaces 51 and 52 of trunnions 45 and 46 are caused to pivot about the downwardly projecting fulcrum pivot points 49 and 50 respectively. This downward force is imparted to pusher 7, via portion 42, causing its lower extending portion 9 to downwardly bend shank portion 31 of spring blade 6. As the shank portion 31 is downwardly deflected, movable contact carrying end 53 of spring blade 6 is caused to travel downwardly bringing contact 25 into engagement with contact 54. During the downward motion of contact carrying end 53, the bearing edges 34 and 35 of trunnions 32 and 33 are caused to pivot within the anchor grooves 16 and 17 of legs 13 and 14, respectively.

Upon releasing the lever actuator 10, the spring tension of blade 6 urges shank 31 in an upward direction causing the pivoting of bearing edges 34 and 35 within their respective anchor grooves 16 and 17 and, the upward movement of pusher 7. The upward travel of pusher 7 causes the lever actuator 10 to move upwardly thereby rotating trunnions 45 and 46 within the respective recesses 47 and 48.

Upwardly projecting portions 55 and 56 may be provided in the recesses 47 and 48, respectively, to maintain each trunnion 45 and 46 in juxtaposition to a respective fulcrum pivot point 49 and 50 thereby removing or reducing unwanted play or tolerance spacing therebetween.

It should be recognized that a plurality of such axially aligned formed recesses may be provided to enable a selective different positioning of the lever actuator 10, during manufacture, to obtain different desired mechanical advantage and movement of the lever actuator 10. The orientation of the recesses 47 and 48 and configuration, for example, size and direction, of the generally downwardly directing pivot points 49 and 45 may require modification to accommodate the different slope angle(s) of the lever actuator 10 when hinge mounted in the other shown but not utilized recesses in accordance with the described embodiment of the invention.

While the invention has been described with respect to its preferred embodiment, it should be apparent to those skilled in the art that numerous modifications may be made thereto without departing from the spirit and scope of the invention.

I claim:

1. A snap action switch, in combination comprising:

a case of electrical insulating material having a pair of projecting spaced apart parallel wall portions, and having an opening for access to the interior of said case disposed between said wall portions, said wall portions each having an alcove with a fulcrum pivot formed integrally therein;

a first fixed contact;

a second fixed contact spaced from and opposed to the first contact;

a first and second spaced transversely apart fixed fulcrum legs each having a transverse groove opening away from said fixed contacts;

a third fixed fulcrum leg having a transverse groove opening toward the fixed contacts and disposed between the fixed contacts and said first and second fulcrum legs;

an integral spring sheet metal snap spring blade comprising two elongated longitudinally extending arms spaced transversely apart, and first and second transverse portions each interconnecting said arms at one end of said blade opposite from the other, said second transverse portion having a tongue projecting therefrom toward said first transverse portion and disposed between said arms, said tongue having a bearing edge disposed transversely of the blade and exposed toward said first transverse portion, contact means fixed to said second transverse portion and having first and second contact surfaces each facing away from a different side of said blade, and elongate shank portion extending from said first transverse portion having a width less than the distance between said first and second leg, said shank portion having an end with two laterally extending trunnions each having a bearing edge pivotally retained in a respective groove of said first and second legs with said bearing edge of the tongue being retained in the groove of said third leg, said blade is configured so that its tongue portion is generally rigid and has a bearing edge for being disposed in the groove of said third leg with the bearing edges of said trunnions being disposed in the respective grooves of the first and second legs thereby trap mounting the blade with said first and second contact surfaces being disposed between the fixed contacts;

a pusher device bearing on the shank portion of the blade and having an actuating portion projecting from said opening in the case between said parallel wall portions; and a flat lever arm having a first and second trunnion extending laterally therefrom each rotatably into a different one of said alcoves and having a flat portion being pivotable on a respective fulcrum pivot point in operative association therewith thereby hinge mounting said lever to the case, said lever having an actuating end portion.

2. A switch comprising:

a casing;

a first contact mounted within the interior space of the casing;

a unitary support means comprising a terminal portion without said casing, a base portion disposed longitudinally within the interior space of said switch, a first portion disposed normal to and at one end of said base portion and having a slot therein a second and a third portion spaced apart and normal to said base portion at the other end thereof with each said second and third portions having a slot therein;

a blade means mounted with spring tension to said support means and comprising a contact carrying end free to move within the interior space of said casing, two spaced apart formed spring tension arm portions interconnected at their respective ends by a first and a second transverse portion, a rigid tongue portion integral with said first transverse portion and disposed between said arm portions and terminating in a bearing edge, and a shank portion integral with said second transverse portion with two laterally extending trunnion portions at its other end;

said blade means being mountable to said support means with said bearing edge of said tongue being held in said slot of said first portion while said laterally extending portions of said shank portions are pivotally disposed within a respective slot of the second and third portions of said support means to thereby retain the blade means mounted with the spring tension of said arm portions; and actuating means operatively associated with said blade means to actuate the free end thereof toward and away from said first contact to make and break contact therewith.

3. A switch as in claim 2, wherein:

said shank portion of said blade is formed to establish a corner/knife edge on said trunnion members in the plane of the tensile load, said corner is configured to be pivotally urged against the adjacent oblique corner of the respective slots of said second and third portions of said support means.

4. A switch as in claim 3, and said casing having two fulcrum pivot points each integrally formed in a respective recess in the casing; and said actuating means including a lever actuator having axially aligning trunnions extending laterally therefrom each having a flat portion pivotable on a respective one of said fulcrum pivot points and a pusher element operatively associated with said blade means and said lever actuator to actuate the free end thereof toward and away from said first contact to make and break contact therewith.

5. A switch as in claim 4, wherein;

said casing includes two spaced apart generally parallel wall portions each having a formed recess containing at least one fulcrum pivot point; and said actuating means includes a lever actuator having axially aligned trunnions extending laterally therefrom each rotatably into one of said recesses and having a flat portion pivotally associated with a fulcrum pivot point within the respective recess, and a pusher element operatively associated with said lever actuator.

6. A switch as in claim 5, wherein:

the casing is of plastic material having the fulcrum pivot points formed integrally therein.

7. A switch as in claim 6, wherein:

the lever actuator is a generally elongate flat shaped metallic lever device having said trunnions at one end and its other end being selectively actuatable.

* * * * *